US005490363A

United States Patent [19]

Woolford

[11] Patent Number: 5,490,363

[45] Date of Patent: Feb. 13, 1996

[54] COMPOSITE MASONRY BLOCK

[75] Inventor: Michael E. Woolford, Lake Elmo, Minn.

[73] Assignee: Anchor Wall Sytems, Inc., St. Paul, Minn.

[21] Appl. No.: 322,357

[22] Filed: Oct. 13, 1994

Related U.S. Application Data

[63] Continuation of Ser. No. 957,598, Oct. 6, 1992, abandoned.

[51] Int. Cl.[6] ..... E04C 1/00

[52] U.S. Cl. ..... 52/604; 52/169.4; 52/561; 52/590.2; 52/606; 52/607; 405/284; 405/286

[58] Field of Search ..... 52/604, 606, 590.2, 52/561, 169.4, 607; 405/284, 286

[56] References Cited

U.S. PATENT DOCUMENTS

| | | |
|---|---|---|
| 126,547 | 5/1872 | Hickcox . |
| 228,052 | 5/1880 | Frost . |
| D. 237,704 | 11/1975 | Lane . |
| D. 279,030 | 5/1985 | Risi et al. . |
| D. 280,024 | 8/1985 | Risi et al. . |

(List continued on next page.)

FOREIGN PATENT DOCUMENTS

| | | |
|---|---|---|
| 22397/85 | 6/1985 | Australia . |
| 52765/86 | 8/1986 | Australia . |
| 80775/87 | 4/1988 | Australia . |
| 338139 | 12/1933 | Canada . |
| 531354 | 10/1958 | Canada . |
| 941626 | 2/1974 | Canada . |
| 1040452 | 10/1978 | Canada . |
| 1065154 | 10/1979 | Canada . |
| 47747 | 1/1981 | Canada . |
| 51160 | 4/1983 | Canada . |
| 51313 | 5/1983 | Canada . |
| 51794 | 9/1983 | Canada . |
| 1182295 | 2/1985 | Canada . |
| 1188116 | 6/1985 | Canada . |
| 1194703 | 10/1985 | Canada . |
| 1197391 | 12/1985 | Canada . |
| 1204296 | 5/1986 | Canada . |
| 62875 | 4/1989 | Canada . |
| 63365 | 5/1989 | Canada . |
| 63366 | 5/1989 | Canada . |
| 65896 | 4/1990 | Canada . |
| 66760 | 8/1990 | Canada . |
| 67904 | 1/1991 | Canada . |

(List continued on next page.)

OTHER PUBLICATIONS

*Diamond Block* Test Report to University of Wisconsin, Platteville (1990).

*Aztech Wall System* Installation Guide, Block Systems, Inc. (1989).

*Windsor Stone* Product Literature, Block Systems, Inc. (1991).

Various Diamond Wall System 4 and 4.4 Concrete Masonry Units Tech Spec's, Anchor Block (1988, 1989).

*Keystone International Compac Unit* Product Literature (1992).

*Keystone Retaining Wall Systems* Product Literature (1992).

*Garden Wall* Product Literature (1991).

*Primary Examiner*—Carl D. Friedman

*Assistant Examiner*—Christopher Todd Kent

*Attorney, Agent, or Firm*—Merchant, Gould, Smith, Edell, Welter & Schmidt

[57] ABSTRACT

The invention is a composite masonry block having a front surface and a back surface which are adjoined by first and second side surfaces, as well as a top surface and a bottom surface each lying adjacent the front, back, and first and second side surfaces. Each of the side surfaces has an inset spanning from the block top surface to the block bottom surface. The block top surface has one or more protrusions positioned adjacent the first and second insets on the block top surface. In use, the blocks may be stacked to provide an interlocking structure wherein the protrusions of one block interfit within the insets of another block. The invention also comprises a method of block molding and a mold assembly which may be used to make a block which may be stackable to form structures of varying setback.

27 Claims, 7 Drawing Sheets

U.S. PATENT DOCUMENTS

D. 284,109 6/1986 Seal, Jr. .
D. 295,788 5/1988 Forsberg .
D. 295,790 5/1988 Forsberg .
D. 296,007 5/1988 Forsberg .
D. 296,365 6/1988 Forsberg .
D. 297,464 8/1988 Forsberg .
D. 297,574 9/1988 Forsberg .
D. 297,767 9/1988 Forsberg .
D. 298,463 11/1988 Forsberg .
D. 299,067 12/1988 Forsberg .
D. 299,069 12/1988 Risi et al. .
D. 300,253 3/1989 Forsberg .
D. 300,254 3/1989 Forsberg .
D. 301,064 5/1989 Forsberg .
D. 311,444 10/1990 Forsberg .
D. 316,904 5/1991 Forsberg .
D. 317,048 5/1991 Forsberg .
D. 317,209 5/1991 Forsberg .
468,838 2/1892 Steiger .
566,924 9/1896 Morrin .
810,748 1/1906 Haller et al. .
831,077 9/1906 Johnson .
847,476 3/1907 Hodges .
884,354 4/1908 Bertrand .
916,756 3/1909 Grant .
1,002,161 8/1911 Lambert .
1,092,621 4/1914 Worner .
1,219,127 3/1917 Marshall .
1,222,061 4/1917 Bartells .
1,248,070 11/1917 Buente .
1,285,458 11/1918 Strunk .
1,287,055 12/1918 Lehman .
1,330,884 2/1920 McDermott .
1,414,444 5/1922 Straight .
1,419,805 6/1922 Bigler .
1,456,498 5/1923 Binns .
1,465,608 8/1923 McCoy .
1,557,946 10/1925 Smith .
1,695,997 12/1928 Evers et al. .
1,727,363 9/1929 Bone .
1,733,790 10/1929 Gilman .
1,751,028 3/1930 Caswell et al. .
1,773,579 8/1930 Flath .
1,907,053 5/1933 Flath .
2,011,531 8/1935 Tranchell .
2,034,851 3/1936 Wichmann .
2,094,167 9/1937 Evers .
2,113,076 4/1938 Bruce .
2,121,450 6/1938 Sentrop .
2,197,960 4/1940 Alexander .
2,219,606 10/1940 Schoick .
2,235,646 3/1941 Schaffer .
2,313,363 3/1943 Schmitt .
2,371,201 3/1945 Wells .
2,570,384 10/1951 Russell .
2,882,689 4/1959 Huch et al. .
2,963,828 12/1960 Belliveau .
3,036,407 5/1962 Dixon .
3,204,316 9/1965 Jackson .
3,274,742 9/1966 Paul, Jr. et al. .
3,378,885 4/1968 Dart .
3,390,502 7/1968 Carroll .
3,430,404 3/1969 Muse .
3,488,964 1/1970 Kubo .
3,557,505 1/1971 Kaul .
3,631,682 1/1972 Hilfiker et al. .
3,754,499 8/1973 Heisman et al. .
3,783,566 1/1974 Nielson .
3,925,994 12/1975 Broms et al. .
3,932,098 1/1976 Huber et al. .
3,936,987 2/1976 Calvin .
3,936,989 2/1976 Hancock .
3,953,979 5/1976 Kurose .
3,995,434 12/1976 Kato et al. .
4,001,988 1/1977 Riefler .
4,016,693 4/1977 Warren .
4,023,767 5/1977 Fontana .
4,067,166 1/1978 Sheahan .
4,098,040 7/1978 Riefler .
4,107,894 8/1978 Mullins .
4,110,949 9/1978 Cambiuzzi et al. .
4,124,961 11/1978 Habegger .
4,126,979 11/1978 Hancock .
4,132,492 1/1979 Jenkins .
4,175,888 11/1979 Ijima .
4,186,540 2/1980 Mullins .
4,187,069 2/1980 Mullins .
4,190,384 2/1980 Neumann .
4,193,718 3/1980 Wahrendorf et al. .
4,207,718 6/1980 Schaaf et al. .
4,208,850 6/1980 Collier .
4,214,655 7/1980 Bernham et al. .
4,218,206 8/1980 Mullins .
4,228,628 10/1980 Schlomann .
4,229,123 10/1980 Heinzmann .
4,262,463 4/1981 Hapel .
4,288,960 9/1981 Auras .
4,312,606 1/1982 Sarikelle .
4,314,431 2/1982 Rabassa .
4,335,549 6/1982 Dean, Jr. .
4,337,605 7/1982 Tudek .
4,380,409 4/1983 O'Neill .
4,384,810 5/1983 Neumann .
4,426,815 1/1984 Brown .
4,454,699 6/1984 Strobl .
4,470,728 9/1984 Broadbent .
4,490,075 12/1984 Risi et al. .
4,496,266 1/1985 Ruckstuhl .
4,512,685 4/1985 Hegle .
4,524,551 6/1985 Scheiwiller .
4,572,699 2/1986 Rinninger .
4,640,071 2/1987 Haener .
4,651,485 3/1987 Osborne .
4,658,541 4/1987 Haile .
4,660,342 4/1987 Salisbury .
4,671,706 6/1987 Giardini .
4,711,606 12/1987 Leling et al. .
4,726,567 2/1988 Greenberg .
4,784,821 11/1988 Leopold .
4,802,320 2/1989 Forsberg .
4,802,836 2/1989 Whissell .
4,815,897 3/1989 Risi et al. .
4,825,619 5/1989 Forsberg .
4,860,505 8/1989 Bender .
4,896,999 1/1990 Ruckstuhl .
4,909,010 3/1990 Gravier .
4,909,717 3/1990 Pardo .
4,914,876 4/1990 Forsberg ..... 52/169.4
5,017,049 5/1991 Sievert .
5,031,376 7/1991 Bender et al. .
5,044,834 9/1991 Janopaul, Jr. ..... 405/284
5,062,610 11/1991 Woolford et al. .
5,158,132 10/1992 Guillemot .

FOREIGN PATENT DOCUMENTS 2012286 9/1991 Canada .
0039372 11/1981 European Pat. Off. .
0130921 1/1985 European Pat. Off. .
0170113 7/1985 European Pat. Off. .
0215991 9/1985 European Pat. Off. .
0322668 12/1988 European Pat. Off. .
0362110 4/1990 European Pat. Off. .

| | | | |
|---|---|---|---|
| 392474 | 11/1908 | France . | |
| 1360872 | 4/1963 | France . | |
| 2228900 | 5/1974 | France . | |
| 2243304 | 9/1974 | France . | |
| 2343871 | 5/1976 | France . | |
| 2422780 | 12/1978 | France . | |
| 2463237 | 8/1979 | France . | |
| 2465032 | 9/1979 | France . | |
| 2259654 | 6/1974 | Germany . | |
| 1811932 | 6/1978 | Germany . | |
| 2755833 | 7/1978 | Germany . | |
| 2719107 | 11/1978 | Germany . | |
| 3401629 | 7/1984 | Germany . | |
| 456776 | 4/1950 | Italy . | |
| 459942 | 10/1950 | Italy . | |
| 709599 | 11/1963 | Italy . | |
| 0709599 | 6/1966 | Italy | 52/606 |
| 205452 | 9/1939 | Switzerland . | |
| 657172 | 8/1986 | Switzerland . | |
| 669001 | 2/1989 | Switzerland . | |
| 336 | of 1871 | United Kingdom . | |
| 537153 | 6/1941 | United Kingdom . | |
| 1385207 | 1/1975 | United Kingdom . | |
| 1386088 | 3/1975 | United Kingdom . | |
| 1477139 | 6/1977 | United Kingdom . | |
| 2091775 | 8/1982 | United Kingdom . | |
| 2127872 | 4/1984 | United Kingdom . | |
| 2213095 | 8/1989 | United Kingdom . | |

FIG. 7
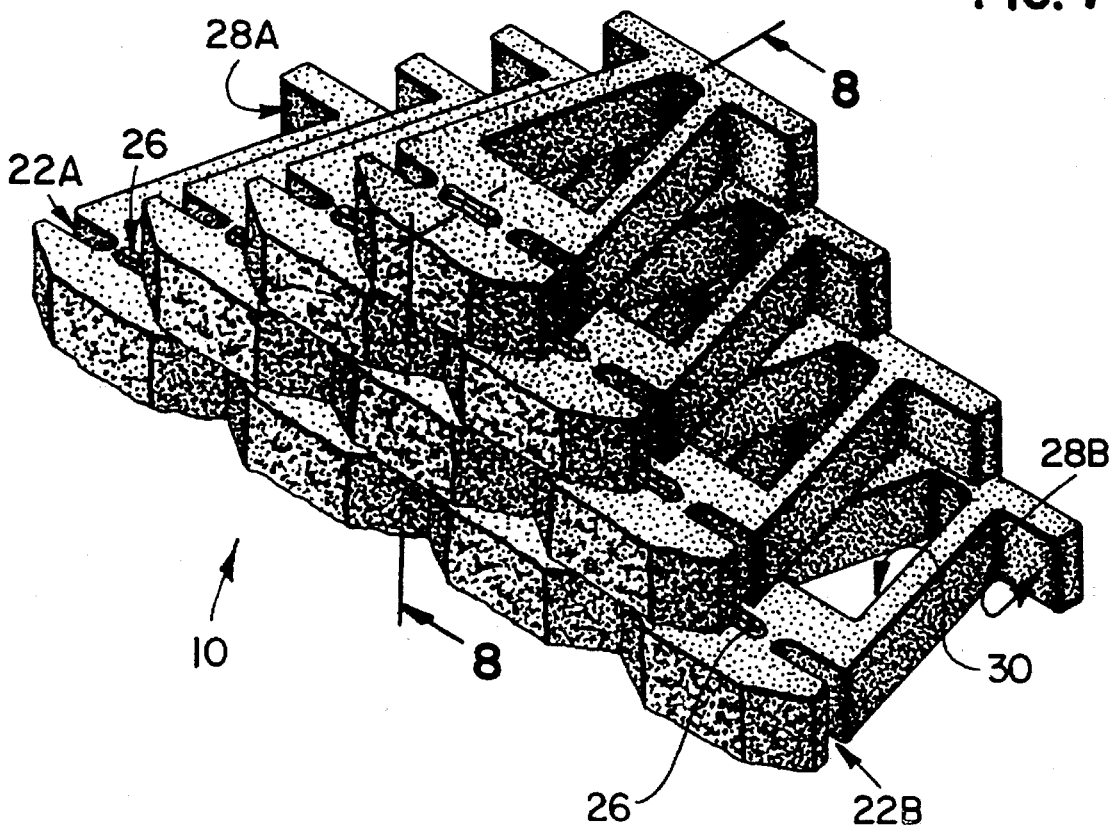
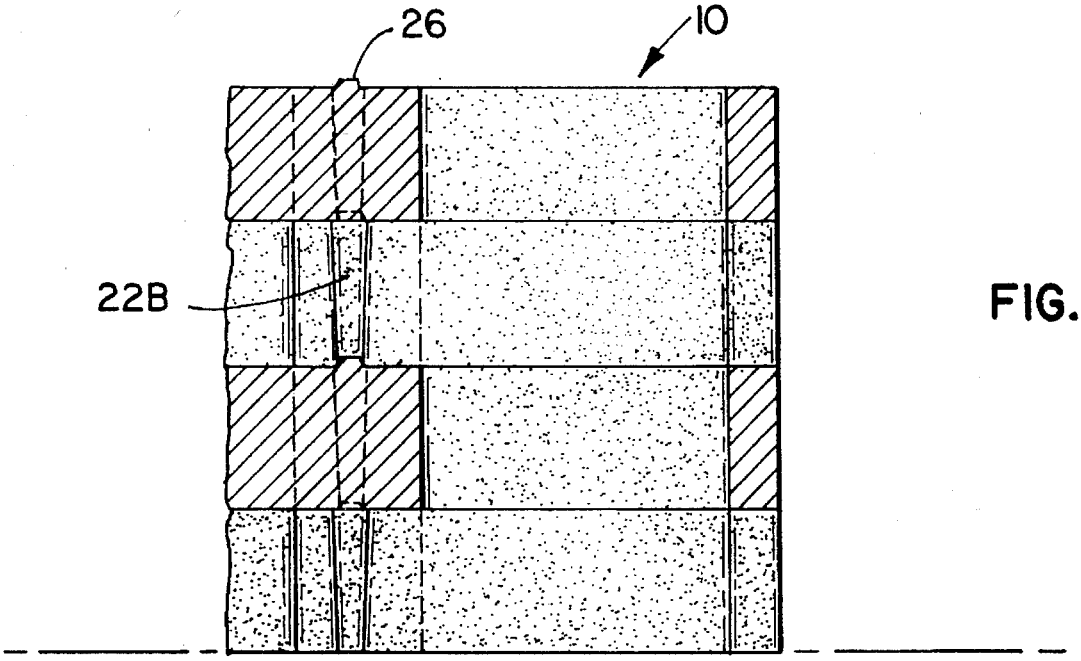
FIG. 8

COMPOSITE MASONRY BLOCK

This is a continuation, of application Ser. No. 07/957,598, filed Oct. 6, 1992, which was abandoned upon the filing hereof.

FIELD OF THE INVENTION

The invention generally relates to concrete masonry blocks. More specifically, the invention relates to concrete masonry blocks which are useful in forming various retaining structures.

BACKGROUND OF THE INVENTION

Soil retention, protection of natural and artificial structures, and increased land use are only a few reasons which motivate the use of landscape structures. For example, soil is often preserved on a hillside by maintaining the foliage across that plain. Root systems from the trees, shrubs, grass, and other naturally occurring plant life, work to hold the soil in place against the forces of wind and water. However, when reliance on natural mechanisms is not possible or practical, man often resorts to the use of artificial mechanisms such as retaining walls.

In constructing retaining walls, many different materials may be used depending on the given application. If a retaining wall is intended to be used to support the construction of a roadway, a steel wall or a concrete and steel wall may be appropriate. However, if the retaining wall is intended to landscape and conserve soil around a residential of commercial structure, a material may be used which compliments the architectural style of the structure such as wood timbers or concrete block.

Of all these materials, concrete block has received wide and popular acceptance for use in the construction of retaining walls and the like. Blocks used for these purposes include those disclosed by Forsberg, U.S. Pat. Nos. 4,802,320 and Design 296,007, among others.

Previously, blocks have been designed to "setback" at an angle to counter the pressure of the soil behind the wall. Setback is generally considered the distance in which one course of a wall extends beyond the front surface of the next highest course of the same wall. Given blocks of the same proportion, setback may also be regarded as the distance which the back surface of a higher course of blocks extends backwards in relation to the back surface of a lower course of the wall.

There is often a need in the development of structures such as roadways, abutments and bridges to provide maximum usable land and a clear definition of property lines. Such definition is often not possible through use of a composite masonry block which results in a setback wall. For example, a wall which sets back by its very nature will cross a property line and may also preclude maximization of usable land in the upper or subjacent property. As a result, a substantially vertical wall is more appropriate and desirable.

However, in such instances, vertical walls may be generally held in place through the use of well known mechanisms such as pins, deadheads, tie backs or other anchoring mechanisms to maintain the vertical profile of the wall. Besides being complex, anchoring mechanisms such as pin systems often rely on only one strand or section of support tether which, if broken, may completely compromise the structural integrity of the wall. Reliance on such complex fixtures often discourages the use of retaining wall systems by the everyday homeowner. Commercial landscapers may also avoid complex retaining wall systems as the time and expense involved in constructing these systems is not supportable given the price at which landscaping services are sold.

Further, retaining structures are often considered desirable in areas which require vertical wall but are not susceptible to any number of anchoring matrices or mechanisms. For example, in the construction of a retaining wall adjacent a building or other structure, it may not be possible to provide anchoring mechanisms such as a matrix web, deadheads or tie backs far enough into the retained earth to actually support the wall. Without a retaining mechanism such as a matrix web, tie-back, or dead head, many blocks may not offer the high mass per face square foot necessary for use in retaining structures which have a substantially vertical profile.

Manufacturing processes may also present impediments to structures of adequate integrity and strength. Providing blocks which do not require elaborate pin systems or other secondary retaining and aligning means and are still suitable for constructing structures of optimal strength is often difficult. Two examples of block molding systems are disclosed in commonly assigned Woolford et al, U.S. Pat. No. 5,062,610 and Woolford, U.S. patent application Ser. No. 07/828,031 filed Jan. 30, 1992 which are incorporated herein by reference. In both systems, advanced design and engineering is used to provide blocks of optimal strength and, in turn, structures of optimal strength, without the requirement of other secondary systems such as pins and the like. The Woolford et al patent discloses a mold which, through varying fill capacities provides for the uniform application of pressure across the fill. The Woolford application discloses a means of forming block features through the application of heat to various portions of the fill.

As can be seen there is a need for a composite masonry block which is stackable to form walls of high structural integrity without the use of complex pin and connection systems and without the need for securing mechanisms such as pins, or tie backs.

SUMMARY OF THE INVENTION

In accordance with a first aspect of the invention, there is provided a pinless composite masonry block having a high unit mass per front surface square foot. The block comprises a front surface and a back surface adjoined by first and second side surfaces, a top surface and a bottom surface each lying adjacent the front, back, and first and second side surfaces. In use, the block may be made to form vertical or set back walls without pins or other securing mechanisms as a result of the high mass per front surface square foot.

In accordance with an additional aspect of the invention there is provided structures resulting from the blocks of the invention.

In accordance with a further aspect of the invention there is provided a mold and method of use resulting in the block of the invention.

BRIEF DESCRIPTION OF THE DRAWINGS

FIG. 7 is a perspective view of a retaining structure constructed with one embodiment of the composite masonry block of the invention.

FIG. 8 is a cut away view of the wall shown in FIG. 7 showing a vertical wall taken along lines 8—8.

DETAILED DESCRIPTION OF THE PREFERRED EMBODIMENT

Figure 1:
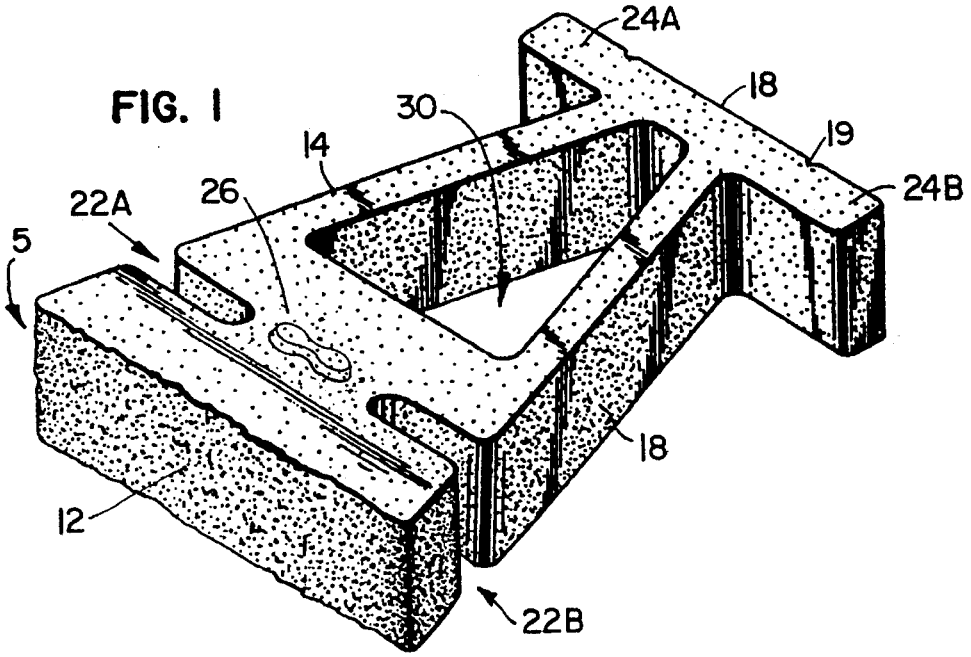
FIG. 1 is a perspective view of one preferred embodiment of the block in accordance with the invention.

Turning to the figures wherein like parts are designated with like numerals throughout several views, there is shown a composite masonry block in FIG. 1. The block generally comprises a front surface 12 and a back surface 18 adjoined by first and second side surfaces 14 and 16, respectively, as well as a top surface 10 and a bottom surface 8 each lying adjacent said front 12, back 18, and first 14 and second 16 side surfaces. Each of said side surfaces has an inset, 22A and 22B, spanning from the block top surface 10 to the block bottom surface 8. The block top surface 10 may also comprise one or more protrusions 26. Each protrusion is preferably positioned adjacent an inset 22A or 22B, on the block top surface 10.

The block back surface 18 generally comprises first and second legs 24A and 24B, respectively. The first leg 24A extends from the back surface 18 beyond the plane of the block first side 14. The second leg 24B extends from the back surface 18 beyond the plane of the block second side 16.

COMPOSITE MASONRY BLOCK

The composite masonry block of the invention generally comprises a block body. The block body 5 functions to retain earth without the use of secondary mechanisms such as pins, dead heads, webs and the like. Preferably, the block body provides a retaining structure which may be manually positioned by laborers while also providing a high relative mass per square foot of face or front surface presented in the wall. To this end, the block may generally comprise a six surface article.

Figure 2:
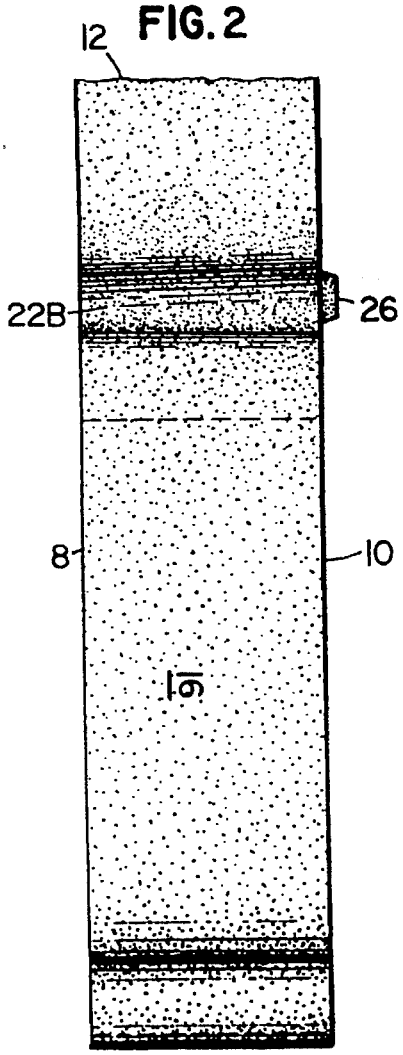
FIG. 2 is a top plan view of the block of FIG. 1.
Figure 3:
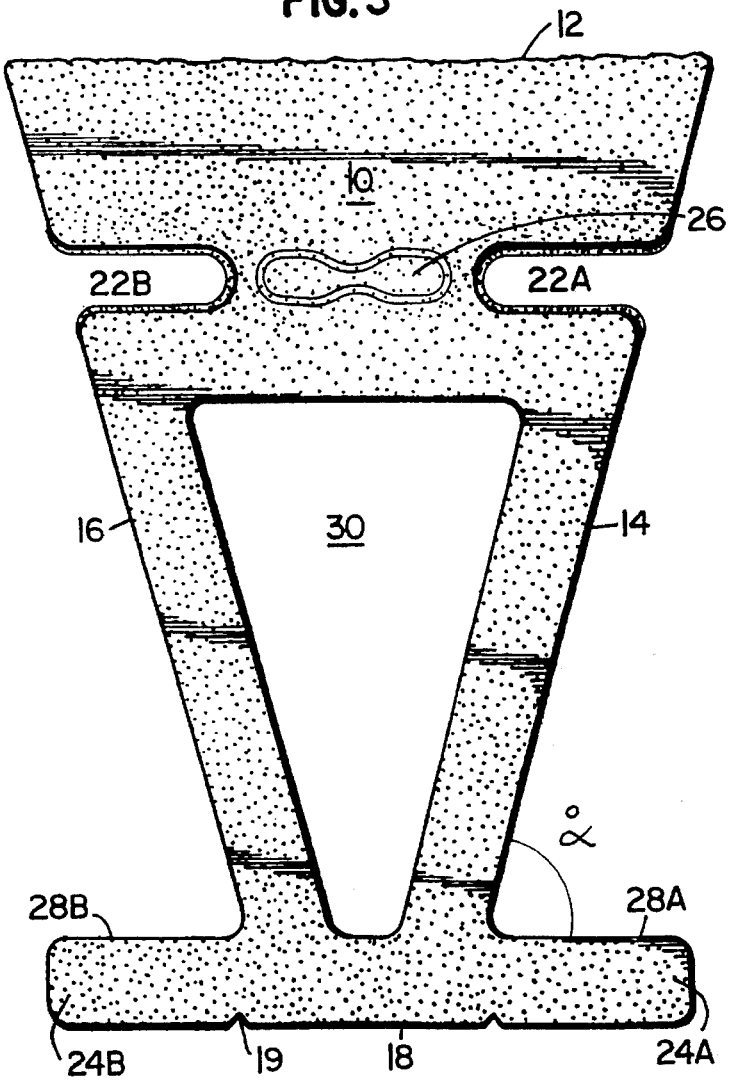
FIG. 3 is a side plan view of the block of FIG. 1.
Figure 6A:
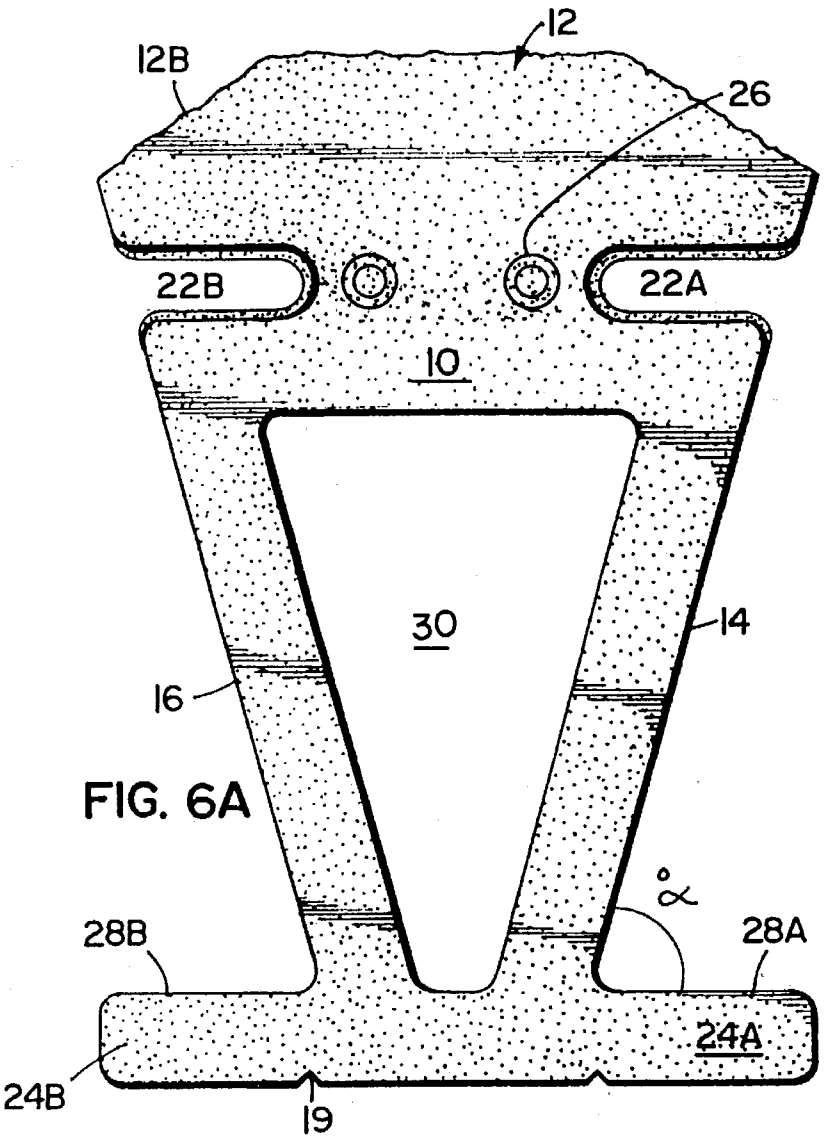
FIG. 6A is a top plan view of one alternative embodiment of the block in accordance with the invention.
Figure 3A:
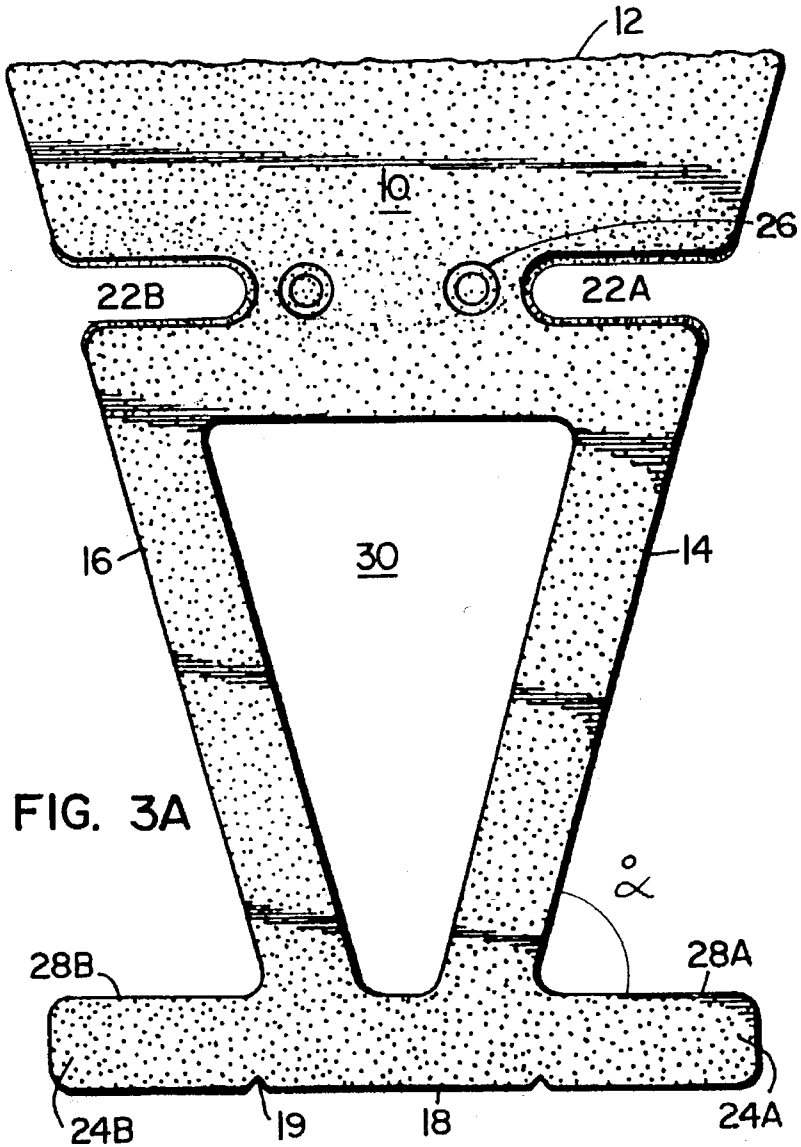
FIG. 3A is a top plan view of one alternative embodiment of the block in accordance with the invention.

The most apparent surface of the block is generally the front surface 12 which functions to provide an ornamental or decorative look to the retaining structure, FIGS. 1–3. The front surface of the block may be flat, rough, split, convex, concave, or radial. Any number of designs may be introduced into the front surface. Two preferred front surfaces may be seen in FIGS. 1–3 and 4–6. The block of the invention may comprise a flat or planar front surface or a roughened front surface 12 created by splitting a portion of material from the front of the block, FIG. 1–3.

Figure 4:
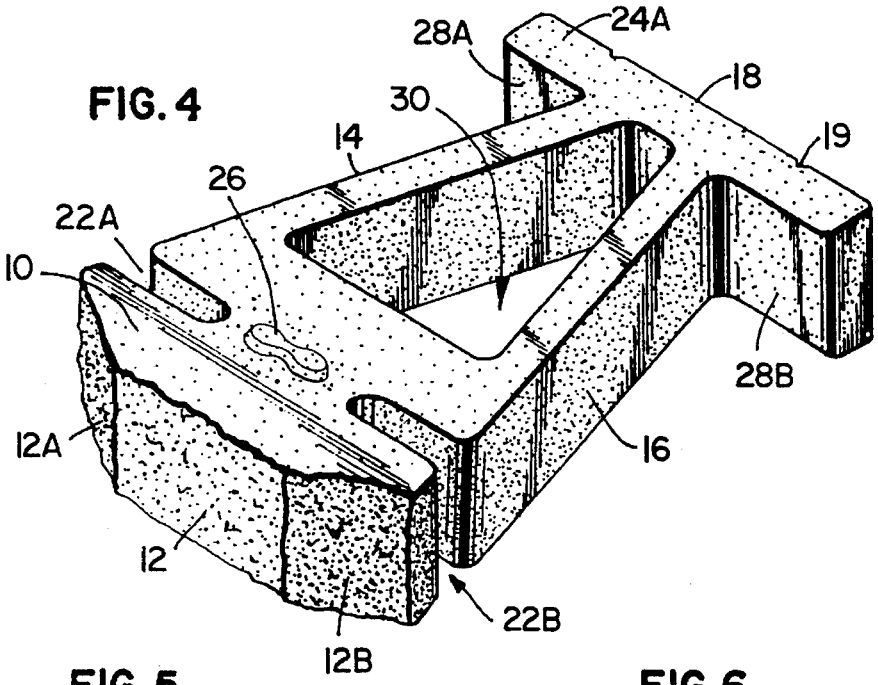
FIG. 4 is a perspective view of an alternative preferred embodiment of the block in accordance with the invention.
Figure 5:
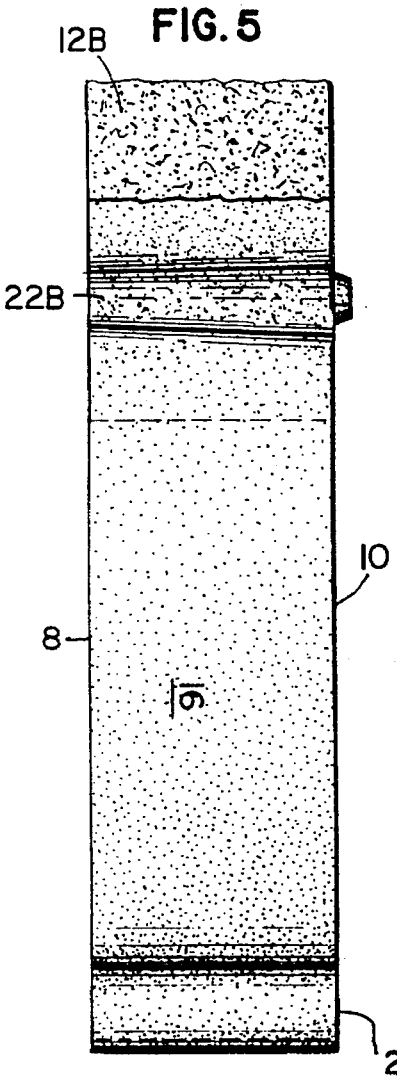
FIG. 5 is a top plan view of the block of FIG. 4.
Figure 6:
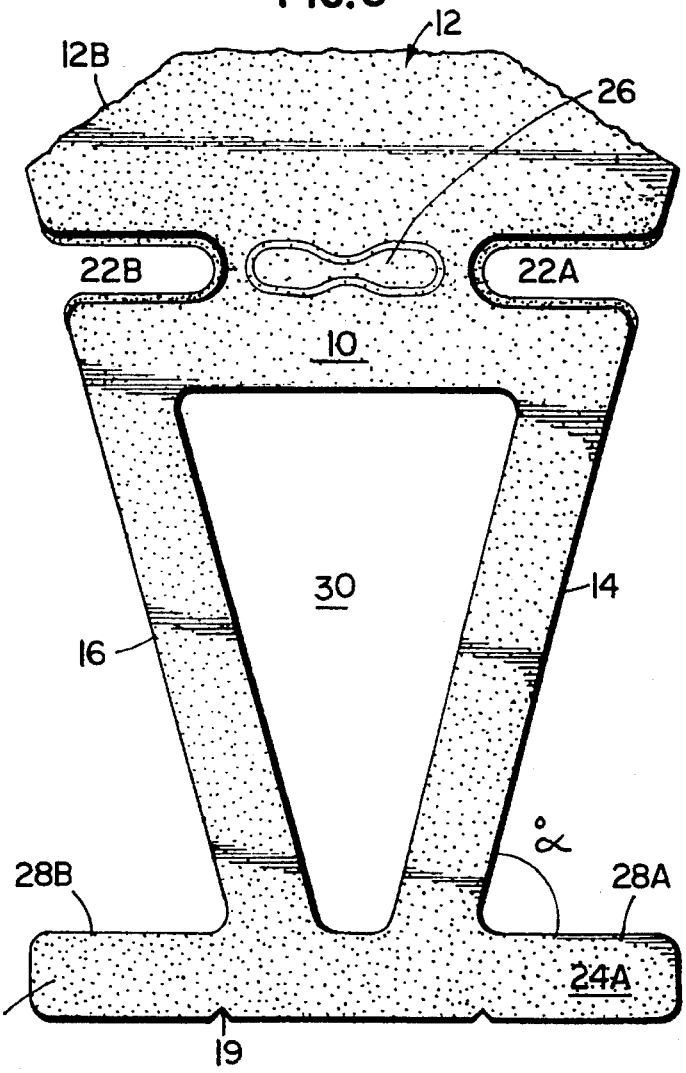
FIG. 6 is a side plan view of the block of FIG. 4.

In accordance with one other embodiment of the invention, the block may comprise a split or faceted front surface having three sides, FIGS. 4–6.

The block of the invention generally also comprises two side surfaces 14 and 16, FIGS. 1–6. These side surfaces assist in definition of the block shape as well as in the stacked alignment of the block. Generally, the block of the invention may comprise side surfaces which take any number of forms including flat or planar side surfaces, angled side surfaces, or curved side surfaces. The side surfaces may also be notched, grooved, or otherwise patterned to accept any desired means for further aligning or securing the block during placement.

One preferred design for the side surfaces may be seen in FIGS. 1–6. As can be seen, the side surfaces 14 and 16 are angled so as to define a block which has a greater width at the front surface 12 than at the back surface 18. Generally, the angle of the side surfaces (See FIGS. 3 and 6) in relationship to the back surface as represented by alpha degrees, may range from about 65° to 85°, with an angle of about 75° to 80°, being preferred.

The side surfaces may also comprise insets 22A and 22B for use in receiving other means which secure and align the blocks during placement. In accordance with one embodiment of the invention, the insets may span from the block top surface 10 to the block bottom surface 8. Further, these insets may be angled across the height of the block to provide a structure which gradually sets back over the height of the wall. When mated with protrusions 26, the insets may also be angled to provide a retaining wall which is substantially vertical.

The angle and size of the insets may be varied in accordance with the invention. However, the area of the inset adjacent the block bottom surface 8 should be approximately the same area as, or only slightly larger than, protrusion 26 with which it will mate. The area of the insets adjacent the block top surface 10 is preferably larger than the protrusion 26 by a factor of 5% or more and preferably about 1% to 2% or more. This will allow for adequate movement in the interfitting of blocks in any structure as well as allowing blocks of higher subsequent courses to setback slightly in the retaining structure.

Generally, the top 10 and bottom 8 surfaces of the block function similarly to the side surfaces of the block. The top 10 and bottom 8 surfaces of the block serve to define the structure of the block as well as assisting in the aligned positioning of the block in any given retaining structure. To this end, the top and bottom surfaces of the block are generally flat or planar surfaces.

Preferably, as can be seen in FIGS. 1–6, either the top or bottom surface comprises a protrusion 26. The protrusion functions in concert with the side wall insets 22A and 22B to secure the blocks in place when positioned in series or together on a retaining structure by aligning the protrusions 26 within the given insets. While the protrusions may take any number of shapes, they preferably have a kidney or dogbone shape. The central depression in the protrusion 26 (FIGS. 1–6) allows for orientation of the blocks to provide inner curving and outer curving walls by the aligned seating of the protrusion 26 within any block inset 22A or 22B.

Generally, the protrusions may comprise formed nodules or bars having a height ranging from about ⅜ inch to ¾ inch, and preferably about ½ inch to ⅝ inch. The width or diameter of the protrusions may range from about 1 inch to 3 inches, and preferably about 1-½ inches to 2-½ inches.

Generally, the protrusions and insets may be used with any number of other means which function to assist in securing the retaining wall against fill. Such devices include tie backs, deadheads, as well as web matrices such as GEOGRID™ available from Mirafi Corp. or GEOMET™ available from Amoco.

The back surface 18 of the block generally functions in defining the shape of the block, aligning the block as an element of any retaining structure, as well as retaining earth or fill. To this end, the back surface of the block may take any shape consistent with these functions.

One preferred embodiment of the block back surface can be seen in FIGS. 1–6. In accordance with the invention, the back surface may preferably be planar and have surfaces 28A and 28B which extend beyond the side surfaces of the block. In order to make the block more portable and easily handled, the block may be molded with a central opening 30. This central opening in the block allows for a reduction of weight during molding. Further, this opening allows for the block to be filled with earth or other product such as stone, gravel, rock, and the like which allows for an increase in the effect mass of the block per square foot of front surface. Additional fill may be introduced into opening 30 as well as the openings formed between surfaces 28A and 28B and adjacent side walls 14 and 16, respectively.

In use, a series of blocks are preferably placed adjacent each other, forming a series of fillable cavities. Each block preferably will have a central cavity 30 for filling as well as a second cavity formed between any two adjacently positioned blocks. This second cavity is formed by opposing side walls 14 and 16, and adjacently positioned back surfaces 28A and 28B. This second cavity, formed in the retaining structure by the two adjacent blocks, holds fill and further increases the mass or actual density of any given block structure per square foot of front surface area.

Generally, an unfilled block may weigh from about 125 to 155 pounds, preferably from about 135 to 150 pounds per square foot of front surface. Once filled, the block mass will vary depending upon the fill used but preferably the block may retain a mass of about 160 to 180 pounds, and preferably about 165 to 175 pounds per square foot of front surface when using rock fill such as gravel or class 5 road base.

BLOCK STRUCTURES

The composite masonry block 5 of the invention may be used to build any number of landscape structures. Examples of the structures which may be constructed with the block of the present invention are seen in FIGS. 7–8. As can be seen in FIG. 7, the composite masonry block of the invention may be used to build a retaining wall 10 using individual courses or rows of blocks to construct a wall to any desired height.

Generally, construction of a structure such as a retaining wall 10 may be undertaken by first defining a trench area beneath the plane of the ground in which to deposit the first course of blocks. Once defined, the trench is partially refilled and tamped or flattened. The first course of blocks is then laid into the trench. Successive courses of blocks are then stacked on top of preceding courses while backfilling the wall with soil.

The blocks of the present invention also allow for the production of serpentine walls. The blocks may be placed at an angle in relationship to one another so as to provide a serpentine pattern having convex and concave surfaces. If the desired structure is to be inwardly curving, blocks of the invention may be positioned adjacent each other by reducing either surface 28A or 28B on one or both blocks. Such a reduction may be completed by striking leg 24A or 24B with a chisel adjacent deflection 19, see FIGS. 1 and 4. Deflection 19 is preferably positioned on the block back surface 18 to allow reduction of the appropriate back surface leg (24A or 24B) while retaining enough potential open area for filling between blocks. Structures made from composite masonry blocks are disclosed in commonly assigned U.S. Pat. No. 5,062,610 which is incorporated herein by reference.

While designed for use without supporting devices, a supporting matrix may be used to anchor the blocks in the earth fill behind the wall. One advantage of the block of the invention is that despite the absence of pins, the distortion created by the block protrusions 26 when mated with insets 22A or 22B anchors the matrix when pressed between two adjacent blocks of different courses.

THE STRIPPER SHOE/MOLD ASSEMBLY

The invention also comprises a heated stripper shoe, a heated stripper shoe/mold assembly and a method of forming concrete masonry blocks with the shoe and mold assembly.

The stripper shoe and mold assembly generally includes a stripper shoe plate 70, having a lower side 75 and an upper side 77. The stripper shoe plate 70 may have indentations to form block details such as those shown at 79 on the shoe lower side 75, (see also 26 at FIGS. 1 and 4). Heat elements 78 may be positioned on the stripper shoe plate upper side 77.

Positioned over the heat elements 78 on the upper surface of the shoe plate is a heat shroud 80 (shown in outline). The heat shroud lower side is configured to cover the heat elements 78. Once the heat shroud 80 is positioned over the upper surface 85 of the stripper shoe plate 70 wiring for the heat elements 78 may be passed through the heat shroud 80 and further into the head assembly.

The assembly may also comprise a standoff 90 which attaches the assembly to the block machine head 95. The standoff 90 is capable of spacing the stripper shoe plate 70 appropriately in the block machine and insulating the head from the heat developed at the surface of the stripper shoe plate 70.

The assembly also comprises a mold 50 having an interior perimeter designed to complement the outer perimeter of the stripper shoe plate 70. The mold generally has an open center 63 bordered by the mold walls.

Positioned beneath the mold is a pallet (not shown) used to contain the concrete fill in the mold and transport finished blocks from the molding machine.

The stripper shoe 70 serves as a substrate on which the heat elements 78 are contained. Further, the stripper shoe plate 70 also functions to form the body of the block as well as detail in the blocks through indentations 79 in the stripper shoe lower surface 75. In use, the stripper shoe 70 functions to compress fill positioned in the mold and, once formed, push or strip the block from the mold 50.

The stripper shoe plate 70 may take any number of designs or forms including ornamentation or structural features consistent with the block to be formed within the mold. Any number of steel alloys may be used in fabrication of the stripper shoe as long as these steel alloys have sufficient resilience and hardness to resist abrasives often used in concrete fill. Preferably, the stripper shoe 70 is made from steel alloys which will resist continued compression and maintain machine tolerances while also transmitting heat from the heat elements through the plate 70 to the fill. In this manner, the total thermal effect of the heat elements is realized within the concrete mix.

Preferably, the stripper shoe plate 70 is made from a carbonized steel which may further be heat treated after forging. Preferred metals include steel alloys having a Rockwell "C"-Scale rating from about 60–65 which provide optimal wear resistance and the preferred rigidity. Generally, metals also found useful include high grade carbon steel of 41-40 AISI (high nickel content, prehardened steel), carbon steel 40-50 (having added nickel) and the like. A preferred material includes carbon steel having a structural ASTM of A36. Preferred steels also include A513 or A500 tubing, ASTM 42-40 (prehardened on a Rockwell C Scale to 20 thousandths of an inch). The stripper shoe plate 70 may be formed and attached to the head assembly by any number of processes known to those of skill in the art including the nut, washer, and bolt mechanisms known to those of skill in the art.

Figure 9A:
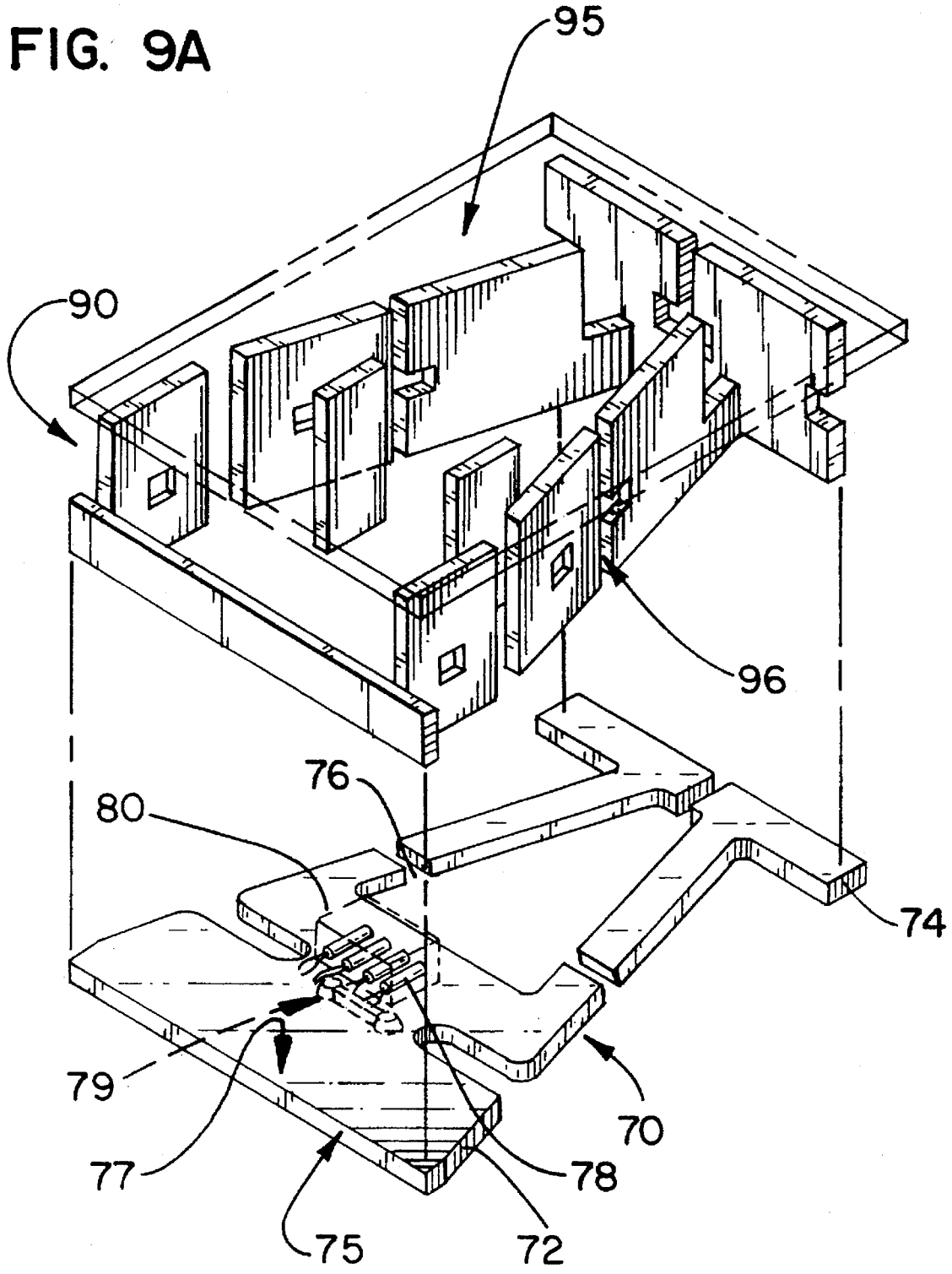
FIG. 9A is an exploded perspective view of the stripper shoe and head assembly of the invention.
Figure 9B:
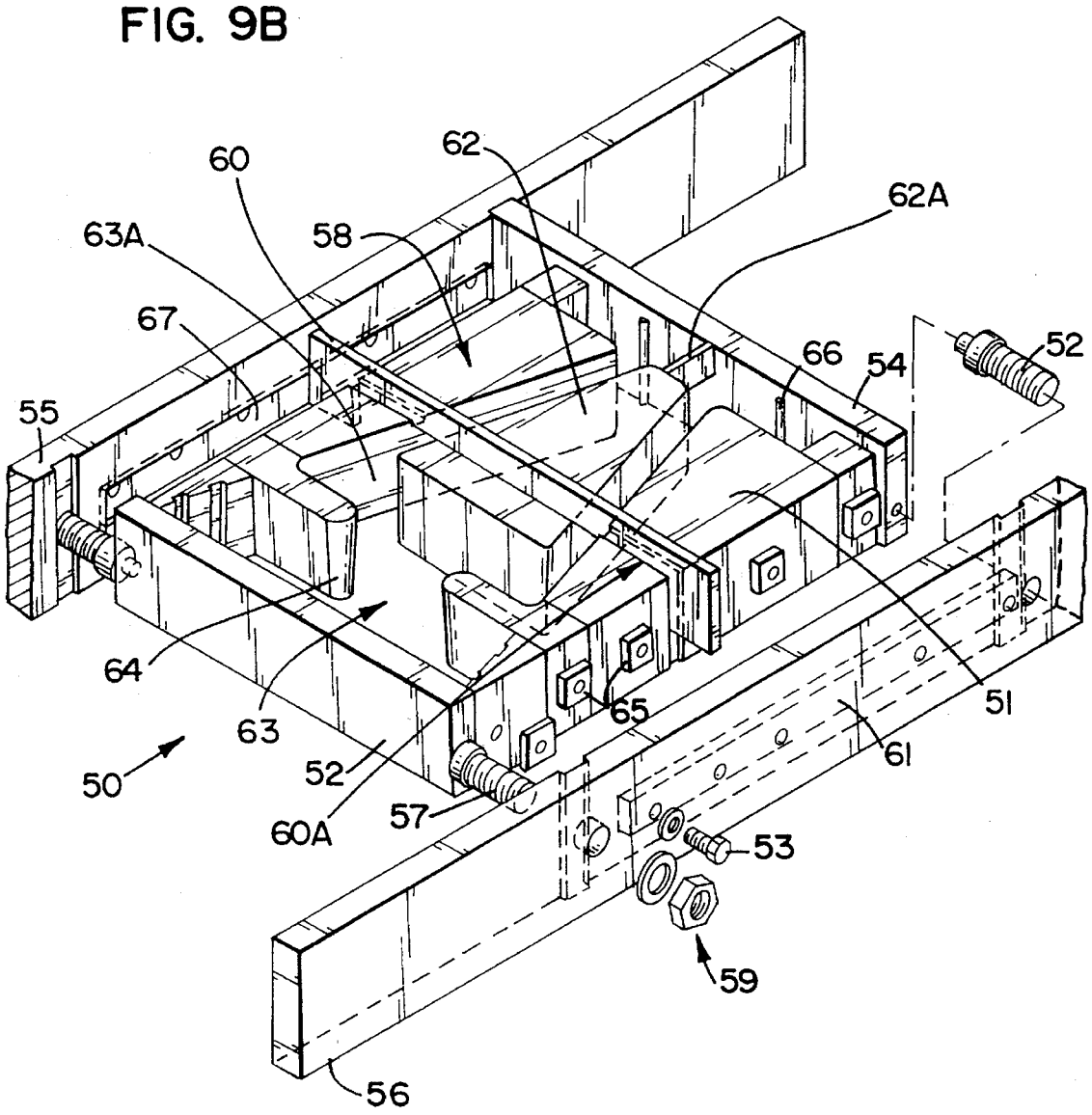
FIG. 9B is perspective view of the mold assembly of the invention.

One preferred heated stripper shoe design which complements the block mold is shown in FIG. 9B. The stripper shoe comprises a first section 72 and a second section 74, with the first section 74 having indentations 79 on the shoe lower side 75. A heat element 78 is positioned over indentation 79. The outer perimeter of the stripper shoe 70 may generally complement the interior outline of the mold 50. Heat elements 78 are preferably positioned adjacent to indentation 79 on the shoe lower side 75 to facilitate the formation of that point of detail created by the indentations 79 in the stripper shoe 70. While generally shown with one form of indentation 79, the stripper shoe plate 70 may be capable of forming any number of designs through indentations in the shoe plate lower surface 75 depending on the nature of the block to be formed.

The invention may also comprise one or more heat elements 78. Generally, the heat element 78 functions to generate and transmit radiant energy to the upper surface 77 of the stripper shoe 70. The heat elements are preferably positioned adjacent indentation 79 in the shoe plate lower surface 75.

Generally, any type and quantity of heat elements 78 may be used in accordance with the invention. However, preferred heat elements have been found to be those which will withstand the heavy vibration, dirt and dust common in this environment. Preferred heat elements are those which are easily introduced and removed from the system. This allows for easy servicing of the stripper shoe assembly without concerns for injury to the operator through thermal exposure or complete disassembly of mold 50, stripper shoe 70, shroud 80, and standoff 90.

The heat element may comprise any number of electrical resistance elements which may be, for example, hard wired, solid state, or semiconductor circuitry, among others. The heat element 78 may generally be positioned over indentations 79 in the stripper shoe lower surface 75, FIG. 9A. By this positioning, the heat element 78 is able to apply heat to the stripper shoe 70 in the area where it is most needed, that is, where the block detail (in this case, protrusion 26, see FIG. 1) is formed in the concrete mix held by the mold.

The heat element 78 may comprise any number of commercially available elements. Generally, the power provided by the heat element may range anywhere from 300 watts up to that required by the given application. Preferably, the power requirements of the heat element may range from about 400 watts to 1500 watts, more preferably 450 watts to 750 watts, and most preferably about 600 watts. Power may be provided to the heat elements by any number of power sources including for example, 110 volt sources equipped with 20 to 25 amp circuit breakers which allow the assembly to run off of normal residential current. If available, the assembly may also run off of power sources such as 3-phase, 220 volt sources equipped with 50 amp circuit breakers or other power sources known to those of skill in the art. However, the otherwise low power requirements of the assembly allow use in any environment with minimal power supplies.

Elements found useful in the invention include cartridge heaters, available from Vulcan Electric Company, through distributor such as Granger Industrial Co. of Minnesota. These elements have all been found to provide easy assembly and disassembly in the stripper shoe of the invention as well as good tolerance to vibration, dirt, dust, and other stresses encountered in such an environment.

Generally, the heat elements may be activated by hard wiring as well as any other variety of electrical feeds known to those of skill in the art. If hard wiring is used, provision may be made to circulate this wiring through the shroud 80 and standoff 90 by various openings 88. The heat element 78 may be externally controlled through any number of digital or analogue mechanisms known to those of skill in the art located at an external point on the block machine.

Heating the stripper shoe elements 78 allows the formation of block detail such as indentations or protrusions, or combinations thereof without the fouling of the shoe plate 70. Detail is essentially formed by case hardening the concrete fill adjacent the element 78. This allows the formation of block detail which is both ornate and has a high degree of structural integrity.

The invention may also comprise means of attaching the heat element 78 to the stripper shoe 70 such as a heat block. Examples of attachment means for the heat elements 76 may be seen in commonly assigned U.S. patent application Ser. No. 07/828,031, filed Jan. 30, 1992, which is incorporated herein by reference.

The stripper shoe may also comprise a heat shroud 80, FIG. 9A, which thermally shields or insulates the heat elements 78 and molding machine. The heat shroud 80 also functions to focus the heat generated by the heat elements 78 back onto the stripper shoe 70.

The heat shroud 80 may take any number of shapes of varying size in accordance with the invention. The heat shroud 80 should preferably contain the heat elements 78. To this end, the heat shroud 80 preferably has a void formed within its volume so that it may be placed over the heat elements 78 positioned on the upper surface 77 of the stripper shoe 70. At the same time, the shroud 80 is preferably positioned flush with the stripper shoe upper surface 77.

Preferably, there is a space between the upper surface of the heat element and the opening or void in the heat shroud 80. Air in this additional space also serves to insulate the standoff and mold machine from the heat created by the heat element 78.

Generally, the heat shroud 80 may comprise any metal alloy insulative to heat or which is a poor conductor of thermal energy. Metal alloys such as brass, copper, or composites thereof are all useful in forming the heat shroud 80. Also useful are aluminum and its oxides and alloys. Alloys and oxides of aluminum are preferred in the formation of the heat shroud 80 due to the ready commercial availability of these compounds. Aluminum alloys having an ASTM rating of 6061-T6 and 6063-T52 are generally preferred over elemental aluminum.

The assembly may additionally comprise a head standoff 90, attached to the stripper shoe plate 70, to position, aid in compression, and attach the head assembly to the block machine.

Generally, the head standoff 90 may comprise any number of designs to assist and serve this purpose. The head standoff may also be used to contain and store various wiring or other elements of the stripper shoe assembly which are not easily housed either on the stripper shoe 70, or the heat shroud 80.

The head standoff 90 may comprise any number of metal alloys which will withstand the environmental stresses of block molded processes. Preferred metals include steel alloys having a Rockwell "C"-Scale rating from about 60–65 which provide optimal wear resistance and the preferred rigidity.

Generally, metals found useful in the manufacture of the head standoff mold of the present invention include high grade carbon steel of 41-40 AISI (high nickel content, prehardened steel), carbon steel 40-50 (having added nickel) and the like. A preferred material includes carbon steel having a structural ASTM of A36. Generally, the head standoff 50 may be made through any number of mechanisms known to those of skill in the art.

The assembly may also comprise a mold 50. The mold generally functions to facilitate the formation of the blocks. Accordingly, the mold may comprise any material which will withstand the pressure to be applied to the block filled by the head. Preferably, metal such as steel alloys having a Rockwell "C"-Scale rating from about 60–65 which provide optimal wear resistance and the preferred rigidity.

Generally, other metals found useful in the manufacture of the mold of the present invention include high grade carbon steel of 41-40 AISI (high nickel content, prehardened steel), carbon steel 40-50 (having added nickel) and the like. A preferred material includes carbon steel having a structural ASTM of A36.

Mold 50 useful in the invention may take any number of shapes depending on the shape of the block to be formed and be made by any number of means known to those of skill in the art. Generally, the mold is produced by cutting the steel stock, patterning the cut steel, providing an initial weld to the pattern mold pieces and heat treating the mold. Heat treating generally may take place at temperatures ranging from about 1000° F. to about 1400° F. from 4 to 10 hours depending on the ability of the steel to withstand processing and not distort or warp. After heat treating, final welds are then applied to the pieces of the mold.

Turning to the individual elements of the mold, the mold walls generally function according to their form by withstanding the pressure created by the block machine. Further, the walls measure the height and the depth of resulting blocks. The mold walls must be made of a thickness which will accommodate the processing parameters of the block formation given a specific mold composition.

Generally, as can be seen in FIG. 9B, the mold comprises a front surface 52, back surface 54, as well as a first side surface 51, and a second side surface 58. As noted, each of these surfaces function to hold fill within a contained area during compression, thus resulting in the formation of a block. Accordingly, each of these mold surfaces may take a shape consistent with this function.

The mold side walls, 51 and 58, may also take any shape in accordance with the function of the mold. Preferably, the side walls each comprise an extension 64 which are useful in forming the insets 22A and 22B in the block of the invention, see FIG. 1. In order to form insets 22A and 22B in the block of the invention, extension 64 may have a dimension which is fairly regular over the depth of the mold.

However, if insets 22A and 22B are required which have a conical shape as seen in FIGS. 2 and 5, the extensions may be formed to have a width at the top of the mold which is greater than the width of the extension at the bottom of the mold. This will result in the insets 22A and 22B which are seen in the various embodiments of the block of the invention shown in FIGS. 1–6 while also allowing stripping of the block from the mold 50 during processing.

The mold may preferably also comprise one or more support bars 60 and core forms 62. The support bars 60 hold the core forms 62 in place within the mold cavity 63. Here again, the support bars may take any shape, size, or material composition which provides for these functions.

As can be seen more clearly in FIG. 9B, support bar 60 is preferably long enough to span the width of the mold 50 resting on opposing side walls 51 and 59. The support bar 60 functions to hold the core 62 within the mold central opening 63. Complementing this function, the support bar 60 is generally positioned in the central area 63A of the opposing side walls 51 and 59. The core form 62 may also be held in place by an additional support 62A (shown in outline) placed between the back wall 54 of the mold 50 and the core form 62. Support bar 60 may also be held in place by a bracket affixed above and around the outer perimeter of the mold 50 at the edges of walls 51, 52, 58, and 54. The use of these various support structures reduces core form vibration during the molding process.

As can be seen in the outline on FIG. 9B, the core form 62 are supported by bar 60 which span the width of the mold 50 resting on the opposing side walls 51 and 59. The core forms have any number of functions. The core forms 62 act to form voids in the resulting composite masonry block. In turn, the core forms lighten the blocks, reduce the amount of fill necessary to make a block, and add to the portability and handleability of the blocks to assist in transport and placement of the blocks.

Also preferred as can be seen in the view provided in FIG. 9B, the core form 62 is affixed to the support bar 60 at insert regions 60A. These insert regions 60A assist in positioning the core forms. As can be seen, the support bar 60 projects upwards from mold 50. As a result, the stripper shoe 70 and stand off 80 may be partitioned or split as can be seen by openings 76 and 96, respectively (FIG. 9A). The separate sections of the shoe 70 and stand off will allow adequate compression of the fill without obstruction by the support bar 60. In turn, the various sections of the stripper shoe 70 and stand off 90 may be held in place by the head 95.

While the mold of the invention may be assembled through any number of means, one manner is that shown in FIG. 9B. Preferably, the mold is held in place by two outer beams 55 and 56, each of which have an interior indentation, 61 and 67 respectively. As can be seen, bolt elements 57 may be fit into the front wall 52 and back wall 54 of the mold 50. The side walls 51 and 58 of the mold may be held in the outer beams of the mold by nut plates 65 sized to fit in indentations 61 and 67. In turn the nut plates 65 may be held within the outer beam indentations 61 by bolt means 53. In this manner, the mold 50 may be held in place even though constructed of a number of pieces.

BLOCK MOLDING

Figure 10:
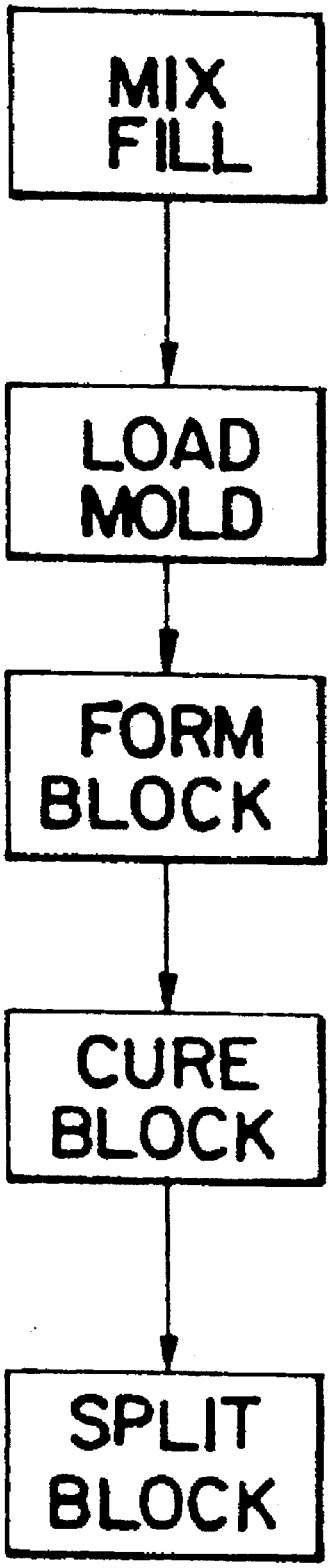
FIG. 10 is a schematic depiction of the molding process of the invention.

An additional aspect of the present invention is the process for casting or forming the composite masonry blocks of this invention using a masonry block mold assembly, FIG. 9. Generally, the process for making this invention includes block molding the composite masonry block by filling a block mold with mix and casting the block by compressing the mix in the mold through the application of pressure to the exposed mix at the open upper end of the block mold. An outline of the process can be seen in the flow chart shown in FIG. 10.

In operation, the assembly is generally positioned in the block molding machine atop of a removable or slidable pallet (not shown). The mold 50 is then loaded with block mix or fill. As configured in FIG. 9, the mold 50 is set to form one block. Once formed and cured, these blocks may be split along the deflections created by flanges 66 which may be positioned on the interior of sidewalls of the mold. Prior to compression, the upper surface of the mold is vibrated to settle the fill and scraped or raked with the feed box drawer (not shown) to remove any excess fill. The mold is then subjected to compression directly by the stripper shoe 70 through head assembly. Upon compression, the stripper shoe 70 forces block fill towards either end of the mold and into the stripper shoe indentation 79 to create a protrusion 26 in the formed block, see FIG. 1. This indentation may range in size for example from about 1 to 3 inches, preferably about 1-½ to 2-½ inches, and most preferably about 1-¾ to 2 inches.

In accordance with the invention, this indentation 79 is heated by elements 78 so that protrusions 26 of minimal size and varying shape may be formed without the build up of fill on the stripper shoe 70 at indentation 79. By doing so, the assembly may be used in the automatic manufacture of blocks by machine.

Blocks may be designed around any number of different physical properties in accordance with ASTM Standards depending upon the ultimate application for the block. For example, the fill may comprise from 75 to 95% aggregate being sand and gravel in varying ratios depending upon the physical characteristics which the finished block is intended to exhibit. The fill generally also comprises some type of cement at a concentration ranging from 4% to 10%. Other constituents may then be added to the fill at various trace levels in order to provide blocks having the intended physical characteristics.

Generally, once determined the fill constituents may be mixed by combining the aggregate, the sand and rock in the mixer followed by the cement. After one to two and one-half minutes, any plasticizers that will be used are added. Water is then introduced into the fill in pulses over a one to two minute period. The concentration of water in the mix may be monitored electrically by noting the electrical resistance of the mix at various times during the process. While the amount of water may vary from one fill formulation to another fill formulation, it generally ranges from about 1% to about 6%.

Once the mold has been filled, leveled by means such as a feed box drawer, and agitated, a compression mechanism such as a head carrying the inventive assembly converges on the exposed surface of the fill. The stripper shoe assembly 30 acts to compress the fill within the mold for a period of time sufficient to form a solid contiguous product. Generally, the compression time may be anywhere from 0.5 to 4 seconds and more preferably about 1.5 to 2 seconds. The compression pressure applied to the head ranges from about 1000 to about 8000 psi and preferably is about 4000 psi.

Once the compression period is over, the stripper shoe 70 in combination with the underlying pallet acts to strip the blocks from the mold 50. At this point in time the blocks are formed. Any block machine known to those of skill in the art may be used in accordance with the invention. One machine which has been found useful in the formation of blocks is a Besser V-3/12 block machine.

Generally, during or prior to compression the mold may be vibrated. The fill is transported from the mixer to a hopper which then fills the mold 50. The mold is then agitated for up to 2 to 3 seconds, the time necessary to ensure the fill has uniformly spread throughout the mold. The blocks are then formed by compressive action by the compressive action the head. Additionally, this vibrating may occur in concert with the compressive action of the head onto the fill in the mold. At this time, the mold will be vibrated for the time in which the head is compressed onto the fill.

Once the blocks are formed, they may be cured through any means known to those with skill in the art. Curing mechanisms such as simple air curing, autoclaving, steam curing or mist curing, are all useful methods of curing the block of the present invention. Air curing simply entails placing the blocks in an environment where they will be cured by open air over time. Autoclaving entails placing the blocks in a pressurized chamber at an elevated temperature for a certain period of time. The pressure in the chamber is then increased by creating a steady mist in the chamber. After curing is complete, the pressure is released from the chamber which in turns draws the moisture from the blocks.

Another means for curing blocks is by steam. The chamber temperature is slowly increased over two to three hours and then stabilized during the fourth hour. The steam is gradually shut down and the blocks are held at the eventual temperature, generally around 120°–200° F. for two to three hours. The heat is then turned off and the blocks are allowed to cool. In all instances, the blocks are generally allowed to sit for 12 to 24 hours before being stacked or stored. Critical to curing operations is a slow increase in temperature. If the temperature is increased too quickly, the blocks may "case-harden". Case hardening occurs when the outer shell of the block hardens and cures while the inner region of the block remains uncured and moist. While any of these curing mechanisms will work, the preferred mechanism is autoclaving.

Once cured the blocks may be split to create any number of functional or aesthetic features in the blocks. Splitting means which may be used in the invention include manual chisel and hammer as well as machines known to those with skill in the art. Flanges 66 (FIG. 9) may be positioned on the interior of the mold 50 side walls to provide a natural weak point or fault which facilitates the splitting action. The blocks may be split in a manner which provides a front surface 12 which is smooth or coarse (FIGS. 1–6), single faceted (FIG. 1) or multifaceted (FIG. 4), as well as planar or curved. For example, the blocks may be split to provide a faceted front surface as shown in FIGS. 4–6 by surfaces 12A, 12, and 12B. Preferably, splitting will be completed by an automatic hydraulic splitter. When split, the blocks may be cubed and stored. Once split, the blocks may be cubed and stored.

The above discussion, examples, and embodiments illustrate our current understanding of the invention. However, since many variations of the invention can be made without departing from the spirit and scope of the invention, the invention resides wholly in the claims hereafter appended.

We claim as our invention:

1. A pinless composite masonry block comprising a front surface, a back surface, a top surface and bottom surface, and first and second sides, said first side having a first inset wherein said first inset extends from said block top surface to said block bottom surface, said second side having a second inset wherein said second inset extends from said block top surface to said block bottom surface, said block comprising a protrusion on one of said top or bottom surfaces, said protrusion, configured to mate with the inset of one or more adjacently positioned blocks.

2. The block of claim 1 wherein said first and second insets are configured to provide an anchoring structure, said anchoring structure comprising said block back wall and a portion of each of said first and second sides.

3. The block of claim 1 wherein said block front surface is substantially planar.

4. The block of claim 1 wherein said block front surface is faceted.

5. The block of claim 1 wherein said block front surface is outwardly curving.

6. The block of claim 1 wherein said protrusion is positioned adjacent at least one of said first and second insets.

7. The block of claim 1 wherein said protrusion extends along said block top surface between said first and second insets.

8. The block of claim 6 wherein said block protrusion comprises first and second oblong sections between which is positioned a joining section, said joining section having a narrower width than either of said first and second oblong sections.

9. The block of claim 1 wherein said block has an open central portion extending from said top surface to said bottom surface.

10. The block of claim 1 wherein said block comprises two protrusions.

11. The block of claim 10 wherein said protrusions are positioned on said block top surface adjacent said first and second insets.

12. A retaining structure comprising the block of claim 1.

13. A pinless composite masonry block comprising a front surface and a back surface, a top surface and bottom surface, and first and second sides, said first side having a first inset wherein said first inset spans from said block top surface to said block bottom surface, said second side having a second inset, wherein said second inset spans from said block top surface to said block bottom surface, a protrusion on one of said block top or bottom surfaces, and, first and second anchoring legs, said first leg extending from said block first side and said second leg extending from said block second side.

14. The block of claim 13 wherein said block front surface is substantially planar.

15. The block of claim 13 wherein said block front surface is faceted.

16. The block of claim 13 wherein said block front surface is outwardly curving.

17. The block of claim 13 wherein said block protrusion comprises first and second oblong sections between which is positioned a joining section, said joining section having a narrower width than either of said first and second oblong sections.

18. The block of claim 13 wherein said block has an open central portion extending from said top surface to said bottom surface.

19. The block of claim 13 wherein said block comprises two protrusions.

20. The block of claim 19 wherein said protrusions are positioned on said block top surface adjacent said first and second inset.

21. A retaining structure comprising the block of claim 13.

22. A retaining wall structure, said retaining wall structure comprising one or more courses, each of said courses comprising one or more pinless composite masonry blocks, each of said blocks comprising a front surface and a back surface, a top surface and bottom surface, and first and second sides, said first side having a first inset wherein said first inset extends from said block top surface to said block bottom surface, said second side having a second inset, wherein said second inset extends from said block top surface to said block bottom surface, a protrusion on one of said block top or bottom surfaces, wherein said block protrusion is configured to mate with the inset of one or more adjacently positioned block.

23. The structure of claim 22 wherein at least one of said blocks comprises first and second legs, said first leg extending from said block first side surface and said second leg extending from said block second side surface.

24. The retaining structure of claim 23 wherein said structure comprises at least an upper and an adjacent lower course wherein the blocks at least one of said upper course or said lower course comprise insets which are seated on the protrusions of the blocks of said adjacent course.

25. The structure of claim 23 wherein said retaining structure comprises a supporting matrix positioned between adjacent blocks of said upper and lower courses.

26. The structure of claim 25 wherein said supporting matrix comprises tie backs positioned between the blocks of said upper and lower courses.

27. The structure of claim 25 wherein said supporting matrix comprises a continuous webbing positioned between the blocks of said upper and lower courses.

* * * * *

Disclaimer 5,490,363 - Michael E. Woolford, Lake Elmo, Minn. COMPOSITE MASONRY BLOCK. Patent dated February 13, 1996. Disclaimer filed August 30, 1999, by the assignee, Anchor Wall Systems, Inc.

Hereby enters this disclaimer to claims 1, 2, 3, 6, 7, 8, 10, 11, 12 and 22 of said patent.

*(Official Gazette,* November 16, 1999)

Disclaimer 5,490,363–Michael E. Woolford, Lake Elmo, MN (US). COMPOSITE MASONRY BLOCK. Patent dated February 13, 1996. Disclaimer filed August 18, 2006, by the assignee, Anchor Wall Systems, Inc.

Hereby enters this disclaimer to claims 4, 5, 9, 13, 14, 15, 16, 17, 18, 19, 20, 21, 23, 24, 25, 26 and 27 of said patent.

(*Official Gazette October 23, 2007*)

Disclaimer

5,490,363 — Michael E. Woolford, Lake Elmo Minn., COMPOSITE MASONRY BLOCK. Patent dated February 13, 1996. Disclaimer filed August 16, 2006, by the assignee, Anchor Wall Systems, Inc., St. paul, Minn.

Hereby enters this disclaimers to claims 4, 5, 9, 13, 14, 15, 16, 17, 18, 19, 20, 21, 23, 24, 25, 26, and 27, of said patent.

(*Official Gazette November 6, 2007*)

US005490363C1

(12) EX PARTE REEXAMINATION CERTIFICATE (6130th)

United States Patent

Woolford

(10) Number: US 5,490,363 C1

(45) Certificate Issued: Feb. 26, 2008

(54) COMPOSITE MASONRY BLOCK

(75) Inventor: Michael E. Woolford, Lake Elmo, MN (US)

(73) Assignee: Anchor Wall Systems, Inc., North St. Paul, MN (US)

Reexamination Request:
No. 90/007,234, Oct. 6, 2004

Reexamination Certificate for:

| | |
|---|---|
| Patent No.: | **5,490,363** |
| Issued: | **Feb. 13, 1996** |
| Appl. No.: | **08/322,357** |
| Filed: | **Oct. 13, 1994** |

Disclaimer of Claims 1, 2, 3, 6, 7, 8, 10, 11, 12 and 22 Filed Aug. 30, 1999 (OG Nov. 16, 1999). Disclaimer of Claims 4, 5, 9, 13, 14, 15, 16, 17, 18, 19, 20, 21 and 23, 24, 25, 26, 27 Filed Aug. 18, 2006 (OG Oct. 23, 2007).

Related U.S. Application Data

(63) Continuation of application No. 07/957,598, filed on Oct. 6, 1992, now abandoned.

(51) Int. Cl.

| | |
|---|---|
| ***E02D 29/02*** | (2006.01) |
| ***E04B 2/02*** | (2006.01) |
| ***E04C 1/00*** | (2006.01) |
| ***E04C 1/39*** | (2006.01) |

(52) U.S. Cl. ..... 52/604; 405/284; 405/286; 52/169.4; 52/561; 52/590.2; 52/606; 52/607

(58) Field of Classification Search ..... None
See application file for complete search history.

(56) References Cited

U.S. PATENT DOCUMENTS

D34,284 S 3/1901 Jacquart (Continued)

FOREIGN PATENT DOCUMENTS

| | | |
|---|---|---|
| DE | 9015196.8 | 4/1991 |
| GB | 107338 | 6/1917 |
| JP | 54-107105 | 7/1979 |
| JP | 54-107106 | 7/1979 |
| JP | 59-167842 | 11/1984 |
| NZ | 92167 | 1/1948 |
| NZ | 151299 | 4/1969 |
| NZ | 218330 | 9/1989 |
| NZ | 215196 | 12/1989 |
| NZ | 25131 | 6/1994 |
| NZ | 25132 | 6/1994 |
| NZ | 27346 | 9/1996 |
| NZ | 27675 | 9/1996 |
| NZ | 27676 | 9/1996 |
| NZ | 27677 | 9/1996 |
| SU | 1145106 | 3/1985 |

OTHER PUBLICATIONS

A document (1 page—labeled R001390) in Japanese and 5 pages (R001391–R001395) of purported English translation of the Japanese document; date uncertain.

Apr. 6, 2006 Decision Granting Petition, filed Aug. 11, 2005, to correct inventorship in U.S. Appl. No. 08/474,097, issued as U.S. Patent No. 5,795,105.

Apr. 6, 2006 Decision Granting Petition, filed Aug. 11, 2005, to correct inventorship in U.S. Appl. No. 09/131,084, issued as U.S. Patent No. 6,113,318.

*Primary Examiner*—Peter C. English

(57) ABSTRACT

The invention is a composite masonry block having a front surface and a back surface which are adjoined by first and second side surfaces, as well as a top surface and a bottom surface each lying adjacent the front, back, and first and second side surfaces. Each of the side surfaces has an inset spanning from the block top surface to the block bottom surface. The block top surface has one or more protrusions positioned adjacent the first and second insets on the block top surface. In use, the blocks may be stacked to provide an interlocking structure wherein the protrusions of one block interfit within the insets of another block. The invention also comprises a method of block molding and a mold assembly which may be used to make a block which may be stackable to form structures of varying setback.

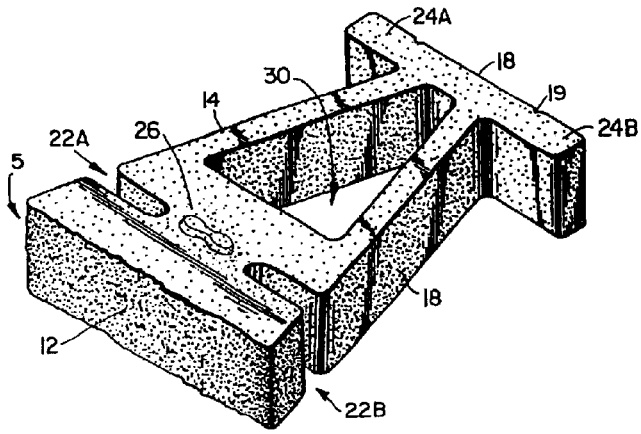

U.S. PATENT DOCUMENTS

| | | | | |
|---|---|---|---|---|
| 786,272 | A | | 4/1905 | Dow |
| 804,240 | A | | 11/1905 | Libby |
| 811,534 | A | | 2/1906 | Akers et al. |
| 2,149,957 | A | | 3/1939 | Dawson |
| D201,966 | S | | 8/1965 | Frese |
| 3,667,186 | A | | 6/1972 | Kato |
| 3,925,994 | A | * | 12/1975 | Broms et al. ..... 405/302.7 |
| 4,196,161 | A | | 4/1980 | Toffolon et al. |
| 4,684,294 | A | | 8/1987 | O'Neill |
| D295,788 | S | | 5/1988 | Forsberg |
| D297,464 | S | | 8/1988 | Forsberg |
| D299,067 | S | | 12/1988 | Forsberg |
| D301,064 | S | | 5/1989 | Forsberg |
| 4,884,921 | A | | 12/1989 | Smith |
| 4,914,876 | A | | 4/1990 | Forsberg |
| 4,920,712 | A | | 5/1990 | Dean, Jr. |
| 4,936,712 | A | | 6/1990 | Glickman |
| 4,964,761 | A | | 10/1990 | Rossi |
| 4,990,032 | A | | 2/1991 | Smith |
| 5,163,261 | A | | 11/1992 | O'Neill |
| 5,249,950 | A | | 10/1993 | Woolford |
| 5,337,527 | A | | 8/1994 | Wagenaar |
| 5,350,256 | A | | 9/1994 | Hammer |
| 5,353,569 | A | | 10/1994 | Rodrique |
| 5,425,600 | A | | 6/1995 | Gordon |
| 5,505,034 | A | | 4/1996 | Dueck |

* cited by examiner

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–3, 6–8, 10–12 and 22 were previously disclaimed.

Claims 4, 5, 9, 13–21 and 23–27 are now disclaimed.

* * * * *